US007967531B2

(12) United States Patent
Collina et al.

(10) Patent No.: US 7,967,531 B2
(45) Date of Patent: Jun. 28, 2011

(54) METHOD OF RAISING A BUILDING

(75) Inventors: Vincenzo Collina, Villagrappa (IT); Gioacchino Marabello, Padua (IT); Roberto Zago, Roverto (IT); Lamberto Zambianchi, Villafranca (IT)

(73) Assignees: S.O.L.E.S. - Societa' Lavori Edili e Serbatoi S.p.A., Forli' (IT); Mattioli S.p.A., Padova (IT)

( * ) Notice: Subject to any disclaimer, the term of this patent is extended or adjusted under 35 U.S.C. 154(b) by 182 days.

(21) Appl. No.: 12/292,749

(22) Filed: Nov. 25, 2008

(65) Prior Publication Data

US 2009/0142140 A1 Jun. 4, 2009

Related U.S. Application Data

(63) Continuation of application No. PCT/IB2007/001362, filed on May 25, 2007.

(30) Foreign Application Priority Data

May 26, 2006 (IT) ..... BO2006A0414

(51) Int. Cl.
*E02D 27/48* (2006.01)
*E02D 35/00* (2006.01)

(52) U.S. Cl. ..... 405/230; 405/229; 405/231

(58) Field of Classification Search ..... 405/229, 405/230, 231, 232
See application file for complete search history.

(56) References Cited

U.S. PATENT DOCUMENTS

| | | | | | |
|---|---|---|---|---|---|
| 1,705,612 | A * | 3/1929 | Gooder | 405/230 |
| 3,040,411 | A * | 6/1962 | Messenger | 405/229 |
| 3,720,034 | A * | 3/1973 | Dawley | 52/169.9 |
| 3,796,055 | A * | 3/1974 | Mahony | 405/230 |
| 4,338,047 | A * | 7/1982 | David | 405/230 |
| 4,507,069 | A * | 3/1985 | Murray et al. | 405/230 |
| 4,563,110 | A * | 1/1986 | Langenbach et al. | 405/230 |
| 4,591,466 | A * | 5/1986 | Murray et al. | 405/230 |
| 5,775,847 | A * | 7/1998 | Carlinsky et al. | 405/229 |
| 6,503,024 | B2 * | 1/2003 | Rupiper | 405/230 |
| 6,814,524 | B1 * | 11/2004 | Peterson | 405/230 |
| 6,923,599 | B2 * | 8/2005 | Kelso | 405/230 |
| 7,556,453 | B2 * | 7/2009 | Collina et al. | 405/230 |
| 2004/0244313 | A1 * | 12/2004 | Baker | 52/122.1 |
| 2008/0152434 | A1 * | 6/2008 | Bracken et al. | 405/230 |
| 2008/0175673 | A1 * | 7/2008 | Roberts et al. | 405/230 |

* cited by examiner

*Primary Examiner* — Frederick L Lagman

(74) *Attorney, Agent, or Firm* — Davidson Berquist Jackson & Gowdey, LLP

(57) ABSTRACT

A method of raising a building with respect to the ground; the method including the steps of: forming a mat having a number of through holes; inserting a foundation pile through each hole; fitting each foundation pile with a lifting device; exerting thrust on the foundation piles by means of the lifting devices to raise the building with respect to the ground; and fixing each foundation pile axially to the mat once the building is raised; the lifting devices are divided into three equivalent, symmetrical, independent work groups; and the lifting devices of one work group at a time are activated simultaneously, so that the building is raised isostatically, by simultaneously activating the lifting devices of one work group at a time, while the lifting devices of the other two work groups are left idle.

19 Claims, 14 Drawing Sheets

METHOD OF RAISING A BUILDING

This application is a continuation of PCT/IB2007/001362, filed on May 25, 2007, which claims foreign priority from an Italian Patent Application, BO2006A000414, filed on May 26, 2006.

TECHNICAL FIELD

The present invention relates to a method of raising a building.

BACKGROUND ART

In the building industry, it is often necessary to raise a building, e.g. to raise a riverside or seafront building above flood or high-tide level. A typical example of this is the city of Venice, where the ground floors of buildings are regularly flooded by so-called "high-water phenomena".

Alternatively, a building may be raised to build a basement underneath, in situations in which excavating underneath the building is undesirable or impossible, or to increase the height, to make full use, of a floor.

Patent IT1303956B proposes a method of raising a building, whereby a new foundation is built comprising a number of through holes; and, for each through hole, a connecting member fixed to the foundation, adjacent to the hole, and projecting at least partly upwards; a pile is then inserted through each hole, and a first thrust is applied statically to the pile to drive it into the ground (the first thrust is applied by a thrust device located over the pile, cooperating with the top end of the pile, and connected to the projecting part of the connecting member, which, when driving the pile, acts as a reaction member for the thrust device). Once all the piles are driven into the ground, a second thrust is applied statically between each pile and the foundation to raise the building with respect to the ground; and, once the building is raised, each pile if fixed axially to the foundation.

Patent Application WO2006016277A1 proposes a method of raising a building resting on a supporting body in turn resting on the ground, whereby a new foundation is built comprising a number of through holes; and a number of connecting members, each fixed to the foundation, close to a hole. A pile is then inserted through each hole, with its bottom end resting on the supporting body, and its top end projecting from the hole; each pile is then fitted with a thrust device, which rests on the top end of the pile on one side, and is connected to the corresponding connecting member on the other side; and, finally, thrust is applied statically to each pile by the thrust device to raise the building with respect to the supporting body. Once the building is raised, each pile is fixed axially to the foundation. The difference between the lifting methods proposed in Patent IT1303956B and Patent Application WO2006016277A1 substantially lies in the fact that, in Patent IT1303956B, each pile is driven individually into the ground before commencing the lifting operation, whereas, in Patent Application WO2006016277A1, a supporting body already exists between the building and the ground, so the building is raised without driving the piles into the ground first.

In the case of a very large building and/or unusual structural situations, the above known methods leave room for improvement, in that, at the actual lifting stage, the building structure has been found to potentially undergo severe stress requiring major consolidation work.

DISCLOSURE OF INVENTION

It is an object of the present invention to provide a method of raising a building, which is cheap and easy to implement and an improvement over the above known methods.

According to the present invention, there is provided a method of raising a building, as claimed in the accompanying Claims.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
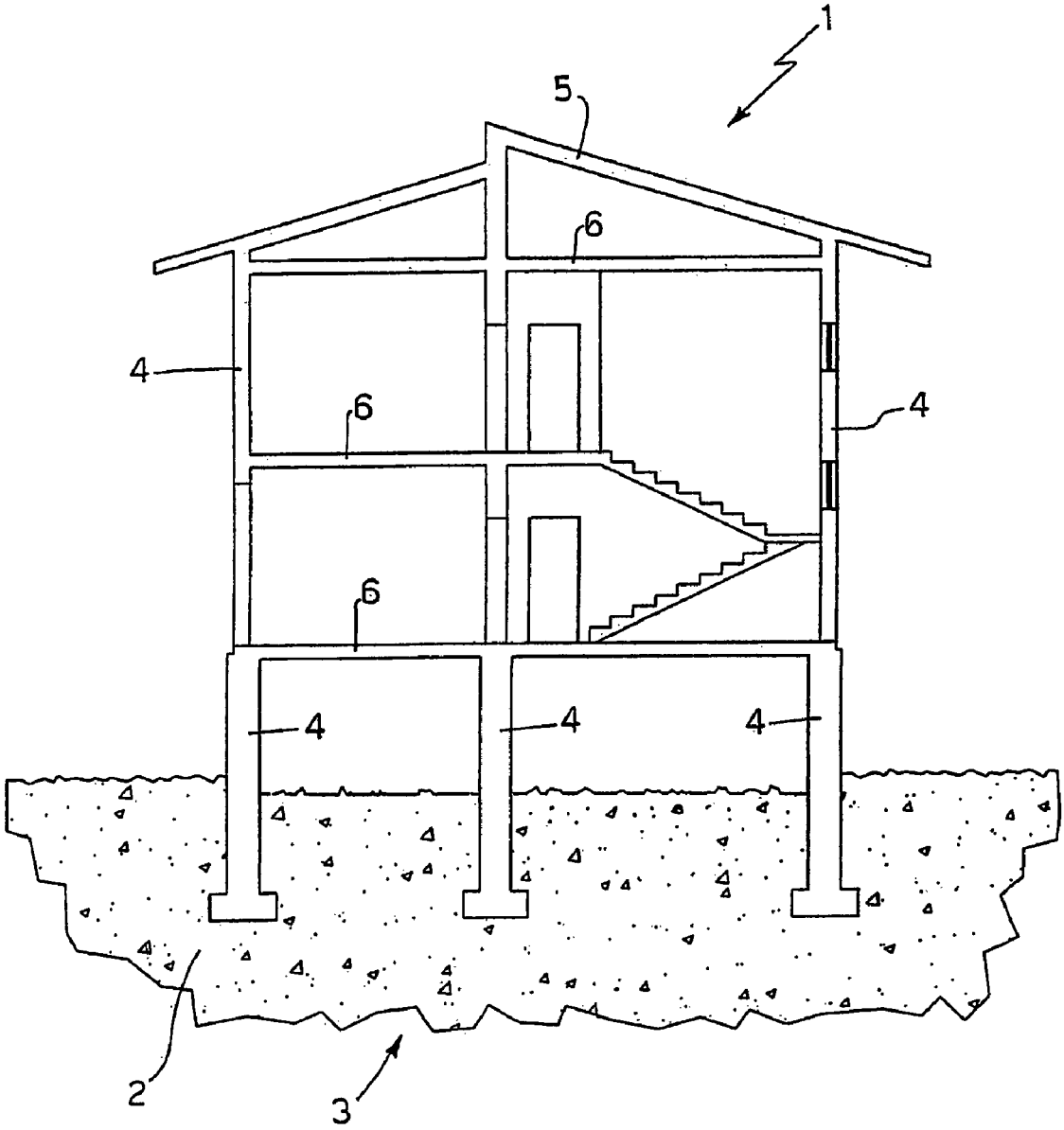
FIGS. 1, 2, 4, 9 and 15 show schematic sections of a building raised using the method according to the present invention.

Number 1 in FIG. 1 indicates as a whole a building resting on the ground 2 on a foundation 3, and to be raised with respect to ground 2. Building 1 comprises a number of supporting walls 4, each of which rests on foundation 3, extends up to a roof 5, and supports four floors 6. Building 1 also comprises a number of nonsupporting walls not shown in the accompanying drawings.

First, a survey of building 1 is conducted to determine the value and distribution of the masses constituting building 1, and which comprises floor plans of the various floors, and drawings of all the walls, showing door and window openings and any damage to the walls. Given the thickness and density of the walls, it is possible to determine their weight and weight distribution.

A static analysis of building 1 is also made to ensure it is capable of safely withstanding lifting-induced stress; and, if necessary, building 1 may be consolidated and strengthened before it is raised.

A survey of ground 2 beneath building 1 is then conducted to obtain detailed information of what is to be found beneath zero level and down to a depth of at least 5 m. Knowing the nature of ground 2 beneath building 1 is essential to select the type of foundation to be constructed (e.g. long piles, short piles or even footings).

Figure 2:
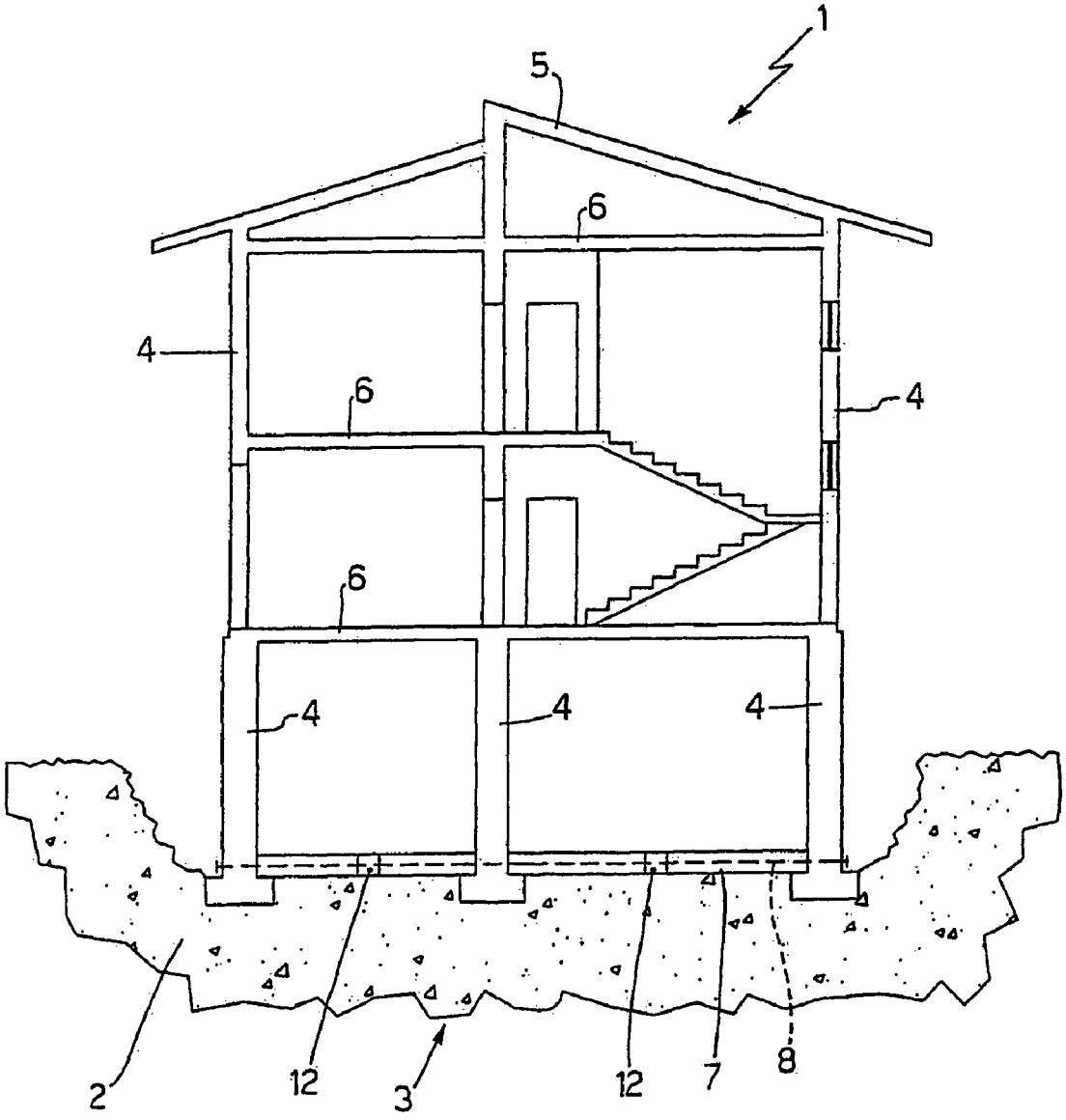
Figure 3:
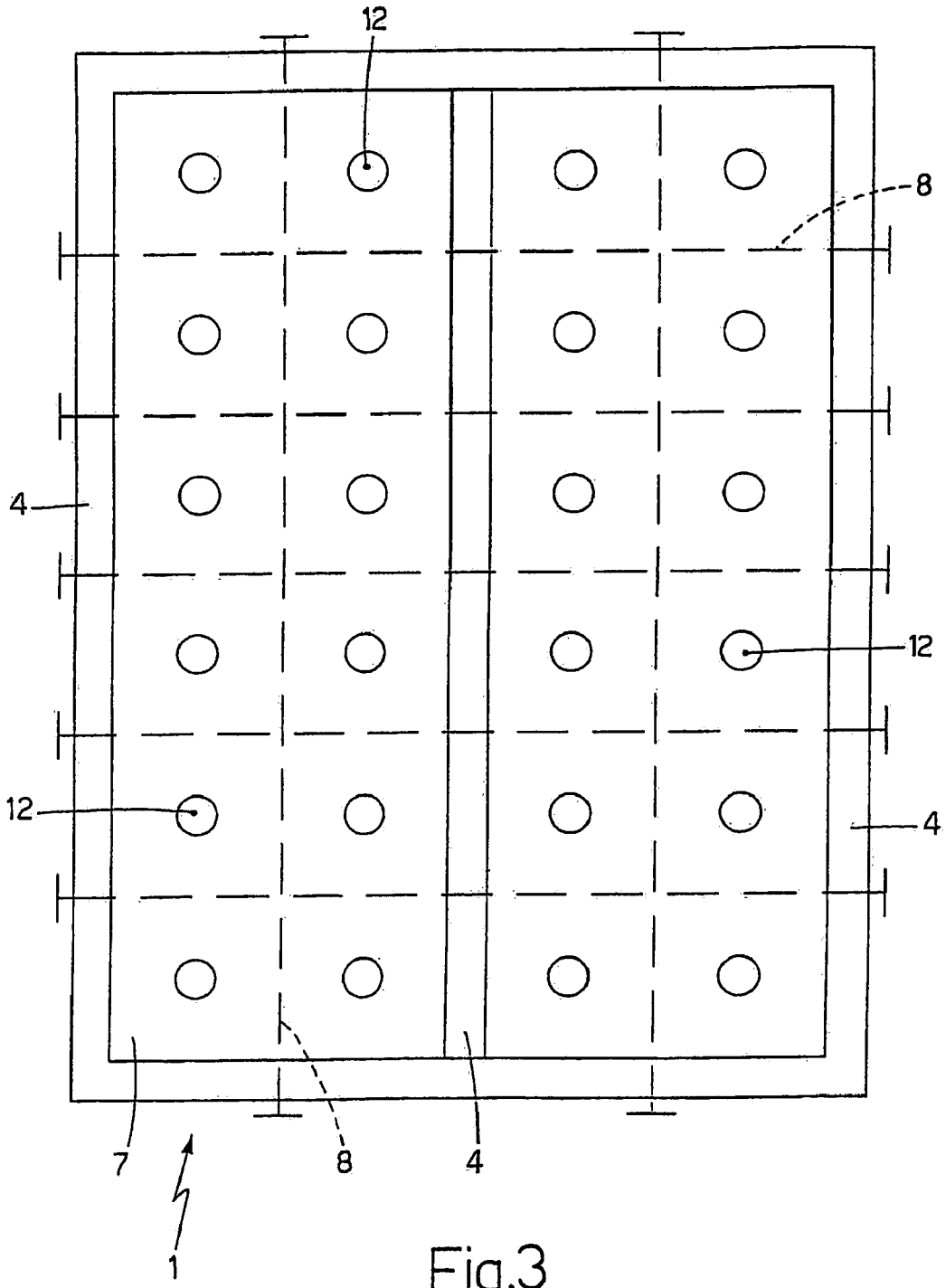
FIGS. 3 and 12 show two schematic plan views of a new foundation of the FIG. 1 building.

As shown in FIGS 2 and 3, a reinforcing mat 7 is first constructed, which forms part of a new foundation, extends over the whole base of building 1, and is made of post tensioned reinforced concrete. In a different embodiment not shown, reinforcing mat 7 is made of normal (i.e. nonprestressed) reinforced concrete. To construct mat 7, ground 2 is normally excavated to a depth at least equal to the thickness of mat 7 and to also permit the building 1 to be detached from the ground and an old pre-existing foundation; and mat 7 is designed rigid and strong enough to absorb the stress produced by eccentricity of the bottom reactions and the distribution of the loads transmitted by supporting walls 4.

Mat 7 is typically constructed in portions extending between the walls. To achieve structural continuity between the various portions of mat 7 and supporting walls 4, mat 7 is posttensioned by means of a number of metal posttensioning cables 8 (shown by dash lines in FIGS. 2 and 3), each of which is embedded in mat 7 and inserted through respective through holes (not shown) in supporting walls 4. By virtue of posttensioning cables 8, the various portions of mat 7 tighten supporting walls 4 to one another to achieve substantial structural continuity, so that flexural and shear continuity are established by supporting walls 4 themselves, interposed between the adjacent portions of mat 7. In a different embodiment not shown, posttensioning cables 8 are replaced with similar high-tensile steel bars.

If supporting walls 4 are not very coherent, cohesion may be improved by resin injection or bolting.

Figure 4:
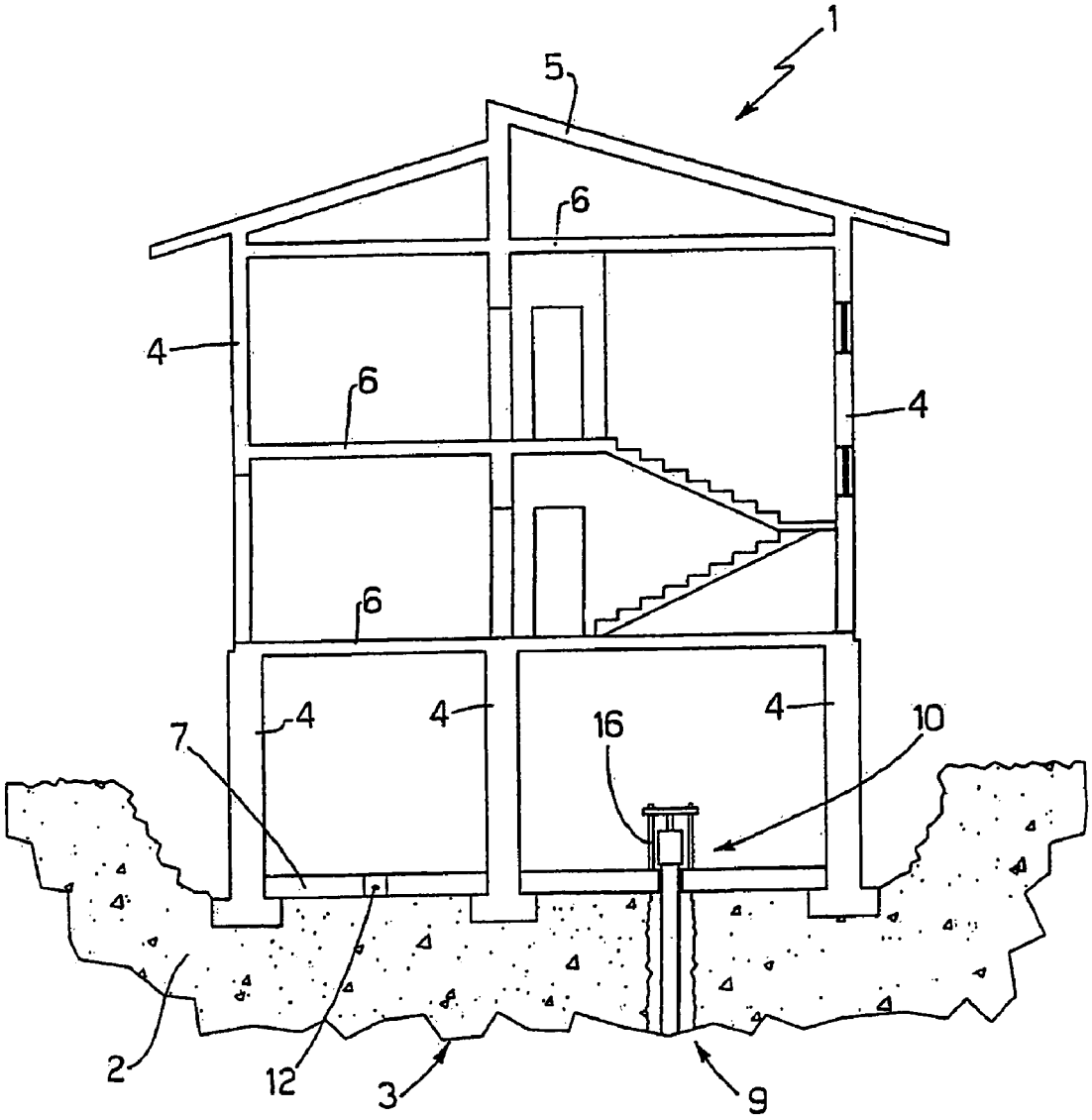
Figure 5:
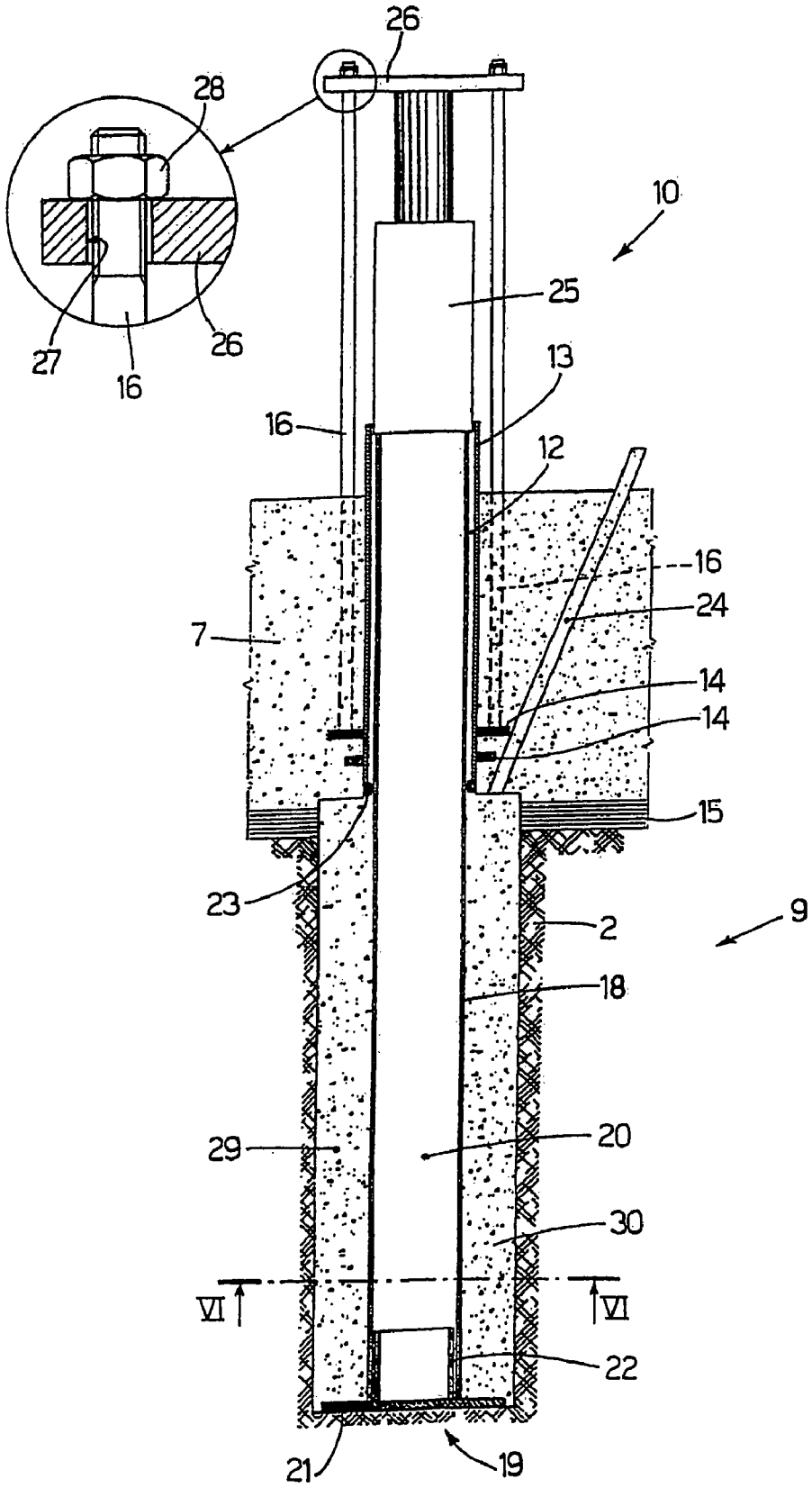
FIG. 5 shows a schematic lateral section of a foundation pile being driven into the ground and connected to a pile-driving device.
Figure 6:
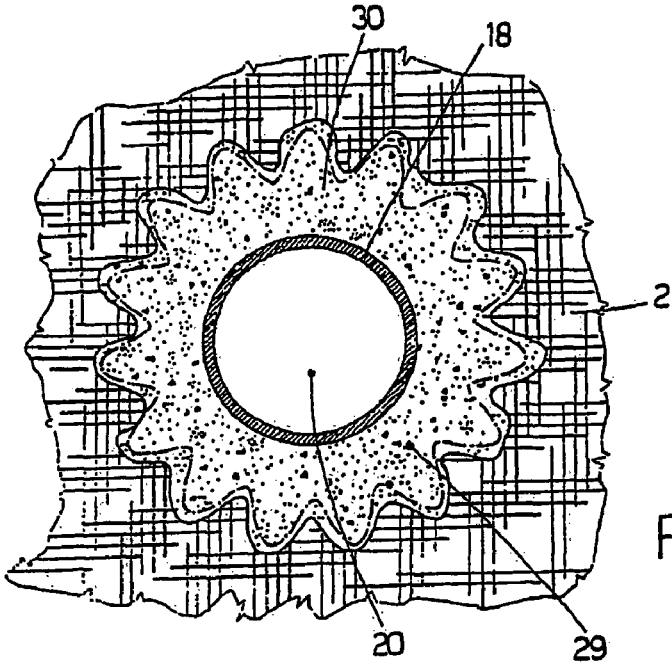
FIG. 6 shows a section along line VI-VI of the FIG. 5 pile.
Figure 9:
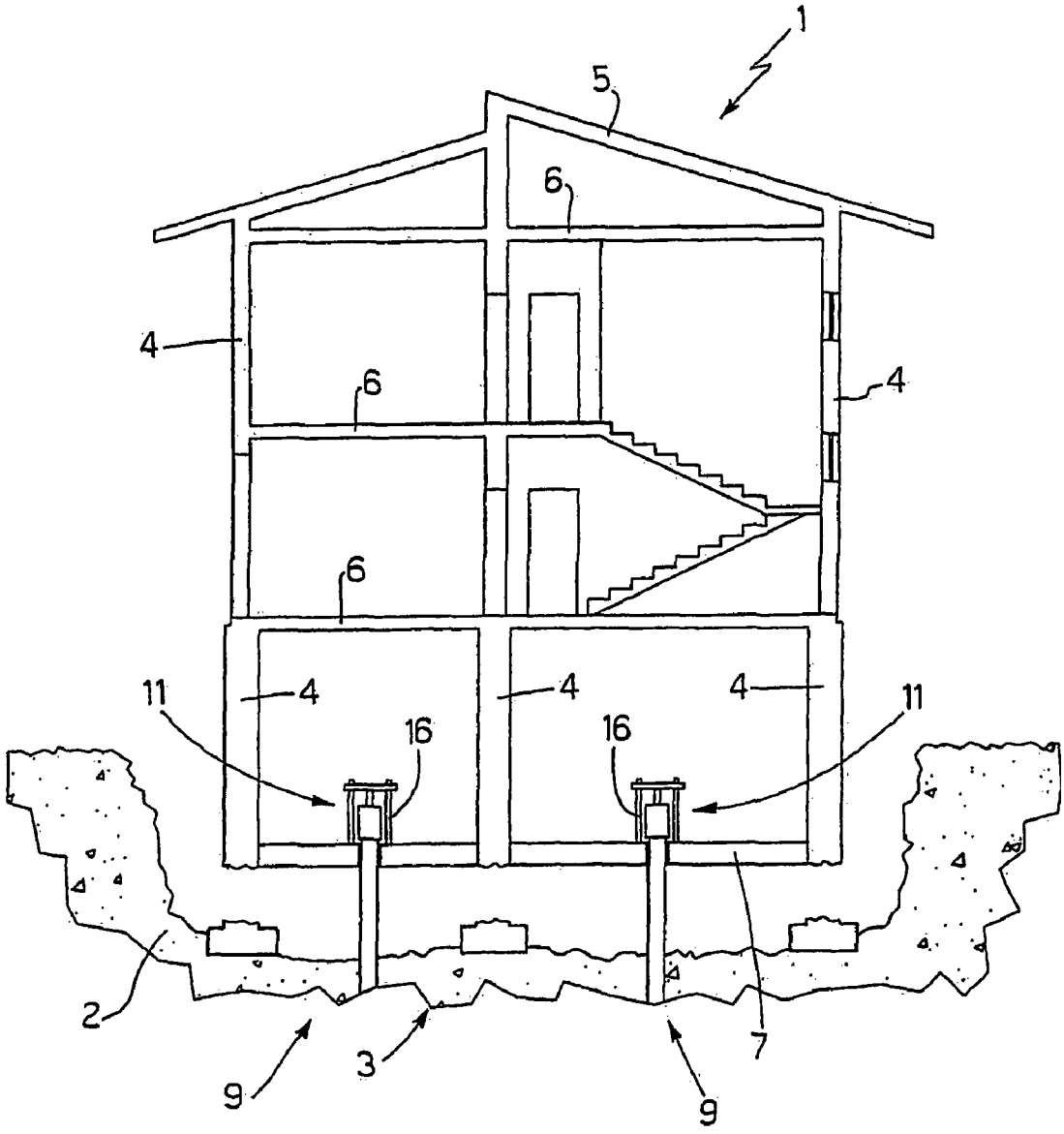

When constructing mat 7, some areas of mat 7 are prepared for subsequently driving foundation piles 9 (shown in FIGS. 4, 5 and 9), for anchoring pile-driving devices 10 (one of which is shown in FIG. 5), and for anchoring lifting devices 11 (one of which is shown in FIG. 9). Foundation piles 9 are distributed over the area of building 1 to balance as best as possible the weight of building 1 and mat 7.

Figure 7:
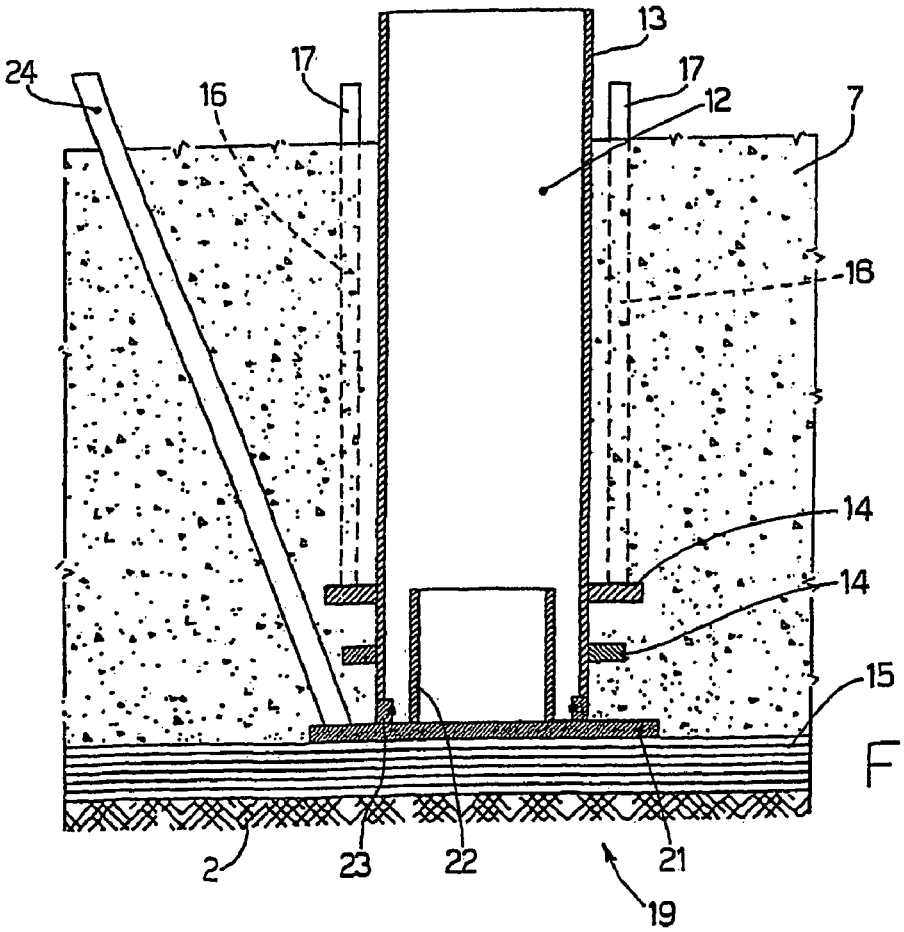
FIG. 7 shows a larger-scale lateral section of an initial configuration before the FIG. 5 pile is driven into the ground.
Figure 8:
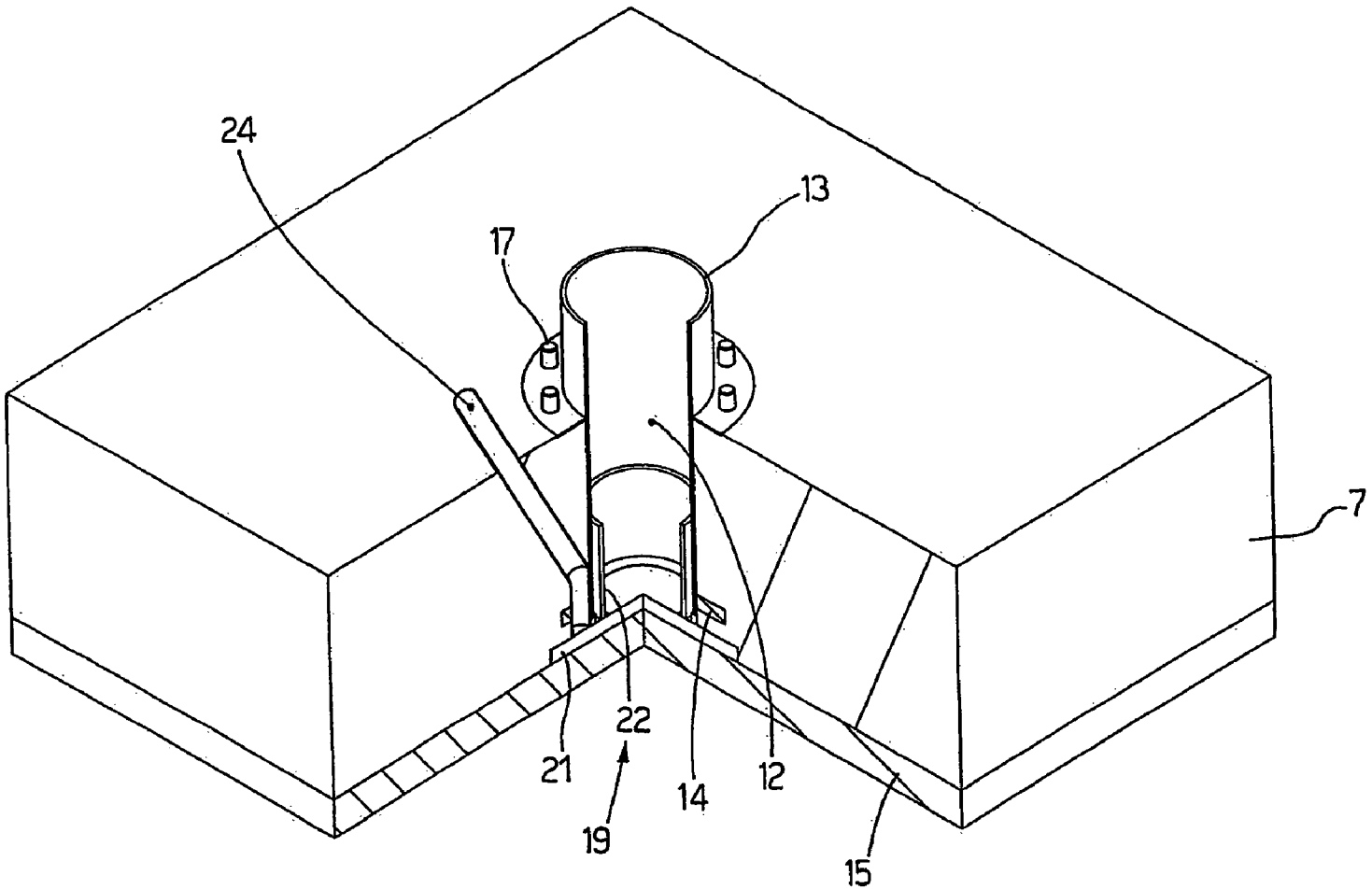
FIG. 8 shows a partly sectioned view in perspective of an initial configuration before the FIG. 5 pile is driven into the ground.

As shown in FIGS. 7 and 8, for each foundation pile 9, mat 7 comprises a vertical hole 12 (of cylindrical or other section) lined with a metal guide tube 13, which is fixed to mat 7 by at least one metal fastening ring 14 embedded in mat 7, and has a top portion projecting upwards from mat 7. A layer 15 of relatively so-called lean concrete is preferably interposed between mat 7 and ground 2. Fastening ring 14 is normally located close to ground 2, i.e. at the bottom of mat 7. One fastening ring 14 is normally enough, though a number of fastening rings 14 may be provided at different levels.

Each hole 12 is surrounded with a number of threaded anchoring ties 16, each of which is connected to fastening ring 14, extends through mat 7, and projects vertically outwards of mat 7. A connector 17 (FIGS. 8 and 11) is screwed to the top portion of each anchoring tie 16 projecting outwards of mat 7, and may be screwed, on the opposite side, with an extension of anchoring tie 16. Anchoring ties 16 are equally spaced about hole 12, and normally number from 6 to 12 for each hole 12. It should be pointed out, however, that, in certain situations, two anchoring ties 16 for each hole 12 may be sufficient.

As shown in FIG. 5, each foundation pile 9 is a metal pile, and comprises a substantially constant-section shaft 18 normally defined by a number of butt welded tubular segments of equal length; and a wide bottom foot 19 defining the bottom end of foundation pile 9. Shaft 18 may obviously be other than circular in section, and may be solid, e.g. may be defined by an I-beam.

Each shaft 18 is tubular, has a through inner conduit 20, and is smaller crosswise than relative hole 12 to fit relatively easily through hole 12. Each foot 19 is defined by a flat, substantially circular plate 21 with a jagged outer edge, but may obviously be defined by a flat plate 21 of a different shape, e.g. oval, square or rectangular, with a jagged or smooth edge. Each foot 19 is larger than or the same size crosswise as relative hole 12, is initially separate from shaft 18, and, when constructing mat 7, is placed substantially contacting ground 2 beneath mat 7 and coaxial with hole 12. Each shaft 18 therefore only engages foot 19 to form foundation pile 9 when shaft 18 is inserted through hole 12.

To ensure sufficiently firm mechanical connection of each shaft 18 to foot 19, foot 19 has a connecting member 22, which engages shaft 18 to fix shaft 18 transversely to foot 19. For example, in the embodiments shown, each connecting member 22 is defined by a cylindrical tubular member, which extends perpendicularly upwards from plate 21, and is sized to relatively loosely engage a bottom portion of inner conduit 20 of shaft 18. Obviously, connecting member 22 may be formed differently.

A bottom end portion of each guide tube 13 is fitted with at least one sealing ring 23 made of elastomeric material, and which engages the outer cylindrical surface of shaft 18 of foundation pile 9, when foundation pile 9 is fitted through corresponding hole 12.

When constructing mat 7, at least one injection conduit 24 is formed at each hole 12, is defined by a metal tube extending through mat 7, and has a top end projecting from mat 7, and a bottom end terminating adjacent to hole 12 and contacting a top surface of plate 21 of foot 19.

As shown in FIGS. 4 and 5, once mat 7 is completed, a foundation pile 9 is driven into ground 2 through each hole 12. More specifically, one foundation pile 9 is driven at a time, or at any rate a small number of foundation piles 9 are driven simultaneously, to minimize stress on mat 7.

Depending on the structural characteristics of mat 7, the characteristics of ground 2, and the characteristics of building 1, each foundation pile 9 is assigned a rated load, i.e. a weight that must be supported by foundation pile 9 without yielding, i.e. without breaking and/or sinking further into ground 2. To ensure the respective rated load is complied with, each foundation pile 9 is normally driven until it is unable to withstand thrust by pile-driving device 10 greater than the rated load without sinking further into ground 2. This operating mode is made possible by driving one foundation pile 9 at a time into ground 2, so that, when driving in foundation pile 9, practically the whole weight of mat 7 and building 1 can be used as a reaction force to the thrust of pile-driving device 10. More specifically, each foundation pile 9 is driven with a force equal to 1.5-3 times the rated load of foundation pile 9, thus ensuring maximum safety of building 1 both during and at the end of the lifting operation.

The way in which each foundation pile 9 is driven into ground 2 will now be described with particular reference to FIG. 5.

To drive foundation pile 9 into ground 2, shaft 18 is first inserted through hole 12 to engage (as described above) foot 19 located beneath mat 7, in contact with ground 2 and coaxial with hole 12. Once shaft 18 engages foot 19 to define foundation pile 9, a pile-driving device 10 is set up over foundation pile 9, cooperates with the top end of foundation pile 9, and is connected to ties 16. In a different embodiment not shown, pile-driving device 10 may be connected to guide tube 13.

In one possible embodiment shown in FIG. 5, pile-driving device 10 comprises a hydraulic jack 25 located between the top end of foundation pile 9 and a top plate 26, which is fitted through with ties 16, and has a number of through holes 27 to slide freely along ties 16. Upward slide of top plate 26 is arrested by a number of bolts 28 screwed to ties 16 on top of top plate 26.

Once connected to respective foundation pile 9 as described above, pile-driving device 10 is operated to expand and exert static thrust on foundation pile 9 to drive foundation pile 9 into ground 2. The reaction force to the thrust exerted by pile-driving device 10 is provided by the weight of mat 7 and building 1, and is transmitted by ties 16, which act as reaction members by maintaining a fixed distance between top plate 26 and mat 7 as hydraulic jack 25 expands, thus driving in foundation pile 9.

Obviously, pile-driving device 10 may be formed differently, providing it exerts static thrust on foundation pile 9 to drive foundation pile 9 into ground 2. For example, pile-driving device 10 may be of the type described in Patent Application IT2004BO00792, which is included herein by way of reference.

As foundation pile 9 is driven into ground 2, foot 19 forms in ground 2 a channel 29 of substantially the same transverse shape and size as foot 19, and which comprises an inner cylindrical portion engaged by shaft 18, and a substantially clear outer tubular portion. Simultaneously with the sinking of foundation pile 9 into ground 2, substantially plastic cement material 30 is pressure-injected along injection conduit 24 into the outer tubular portion of channel 29. More specifically, cement material 30 is substantially defined by microconcrete for fluidity and smooth pressure-injection along injection conduit 24. Sealing ring 23 prevents the pressure-injected cement material 30 from leaking upwards through the gap between the outer surface of shaft 18 and the inner surface of guide tube 13.

If ground 2 has a tendency to shrink (as in the case of peat layers), substances (e.g. bentonite) may be added to cement material 30 to reduce friction (and therefore adhesion) of ground 2 with respect to cement material 30 as it dries, and so allow ground 2 to shrink freely and naturally with time. Waterproofing substances may also be added to cement material 30 to make it substantially waterproof even prior to curing. This is necessary when foundation pile 9 is sunk through groundwater, particularly high-pressure and/or relatively fast-flowing groundwater, and prevents cement material 30 from being washed away and so degraded. Tests also show that, when working through groundwater, it is important to inject cement material 30 at higher than the water pressure, to avoid the formation of breaks in cement material 30.

As stated, each shaft 18 is divided into segments, which are driven successively, as described above, through hole 12 and welded to one another. More specifically, once a first segment of shaft 18 is driven, pile-driving device 10 is detached from the top end of the first segment to insert a second segment, which is butt welded to the first (possibly with a connecting piece in between); and pile-driving device 10 is then connected to the top end of the second segment to continue the driving cycle. The segments forming each shaft 18 are normally identical, but, in certain situations, may differ in length, shape or thickness.

As shown in FIG. 9, once mat 7 is formed and all the foundation piles 9 are driven, building 1 is detached from the ground and a pre-existing foundation or the bottom of support walls 4 as shown, and then building 1 can be raised.

To do this, each foundation pile 9 is fitted with a lifting device 11 resting on the top end of foundation pile 9 on one side, and connected to ties 16 on the other side. In actual use, each lifting device 11 is operated to produce, between foundation pile 9 and mat 7, static thrust which is transmitted to mat 7 by ties 16.

Figure 10:
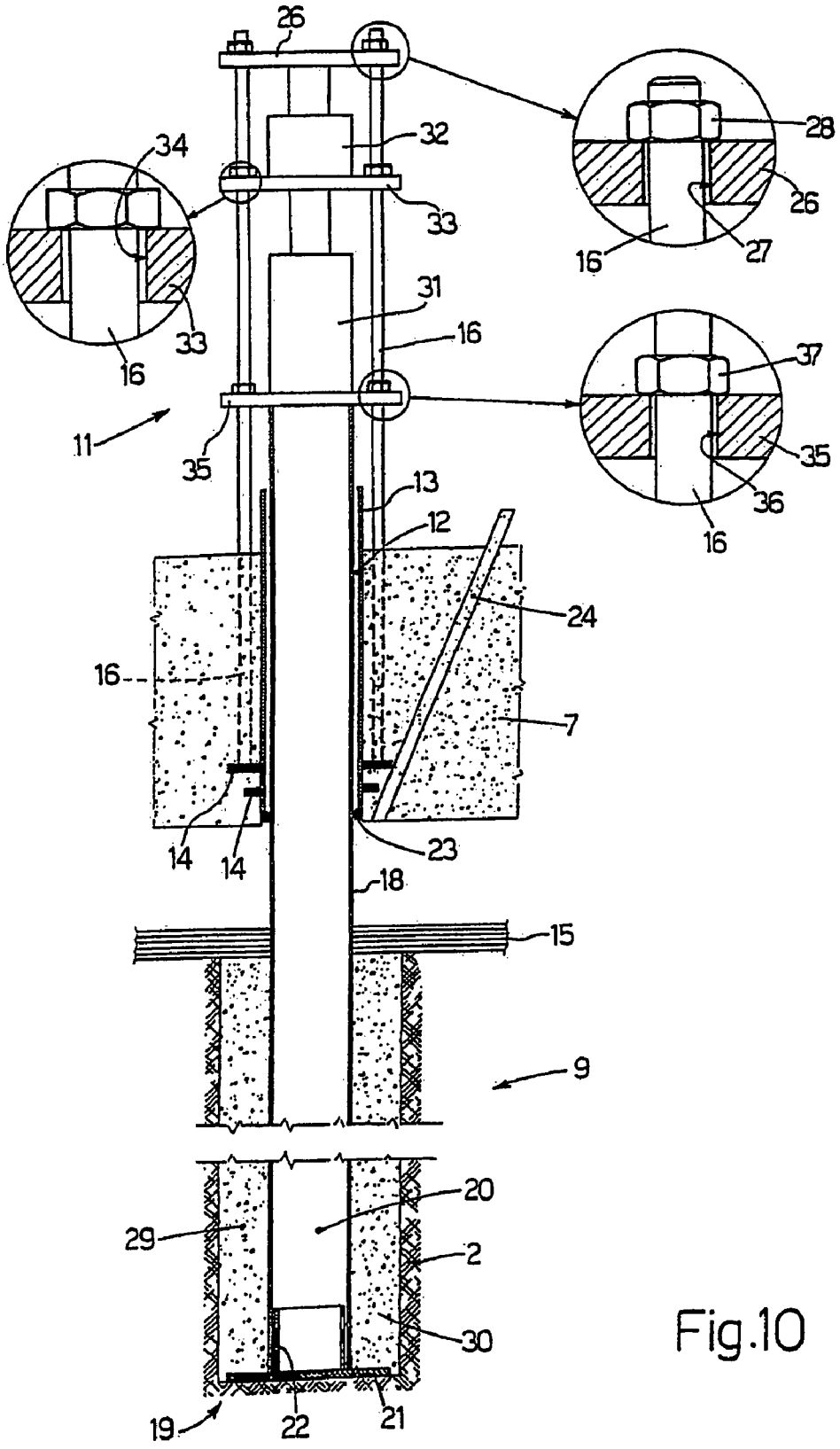
FIG. 10 shows a schematic lateral section of a foundation pile connected to a lifting device.
Figure 11:
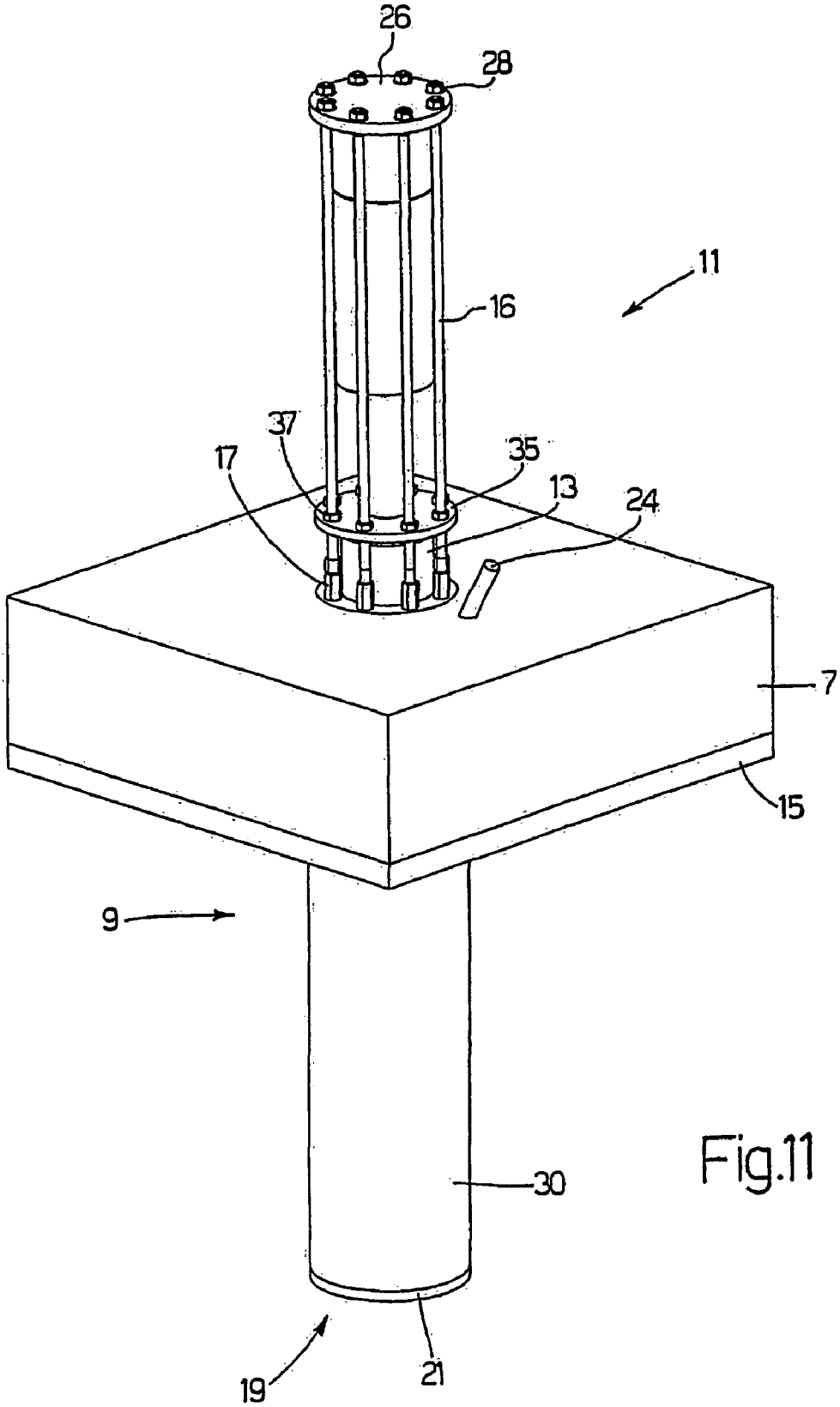
FIG. 11 shows a view in perspective of a foundation pile connected to a lifting device.

As shown in FIGS. 10 and 11, each lifting device 11 comprises a main long-stroke hydraulic jack 31 and a secondary short-stroke hydraulic jack 32 arranged mechanically in series one over the other; and an intermediate plate 33 is preferably interposed between hydraulic jacks 31 and 32, is fitted through with ties 16, and has a number of through holes 34 to slide freely along ties 16. Hydraulic jacks 31 and 32 are located between a bottom plate 35—which rests on the top end of foundation pile 9, is fitted through with ties 16, and has a number of through holes 36 to slide freely along ties 16—and top plate 26, which is fitted through with ties 16, and has a number of through holes 27 to slide freely along ties 16. Upward slide of top plate 26 is arrested by a number of bolts 28 screwed to ties 16 on top of top plate 26.

In actual use, each hydraulic jack 31, 32 is operated to expand and so exert thrust, between foundation pile 9 and mat 7, which is transmitted to mat 7 by ties 16, which act as reaction members by maintaining a fixed distance between top plate 26 and mat 7 as hydraulic jack 31, 32 expands.

In a preferred embodiment, ties 16 are fitted with safety bolts 37 located on top of and kept close to bottom plate 35 to limit downward travel of mat 7 in the event of a breakdown (hydraulic failure, resulting in loss of pressure, or mechanical failure) of hydraulic jack 31, 32.

As shown in FIG. 9, once all the lifting devices 11 are set up as described above, hydraulic jacks 31, 32 can be operated to commence raising building 1. Depending on the height to which the building is to be raised, shaft 18 of each foundation pile 9 may be either a one-piece body, or comprise a number of connected tubular segments, which are inserted successively through hole 12 and welded to one another as building 1 is raised with respect to ground 2. In other words, on reaching the end of a first segment of shaft 18, lifting device 11 is detached from the top end of the first segment to insert a second segment, which is butt welded to the first (possibly with a connecting piece in between); and lifting device 11 is then connected to the top end of the second segment to continue the lift cycle.

Figure 12:
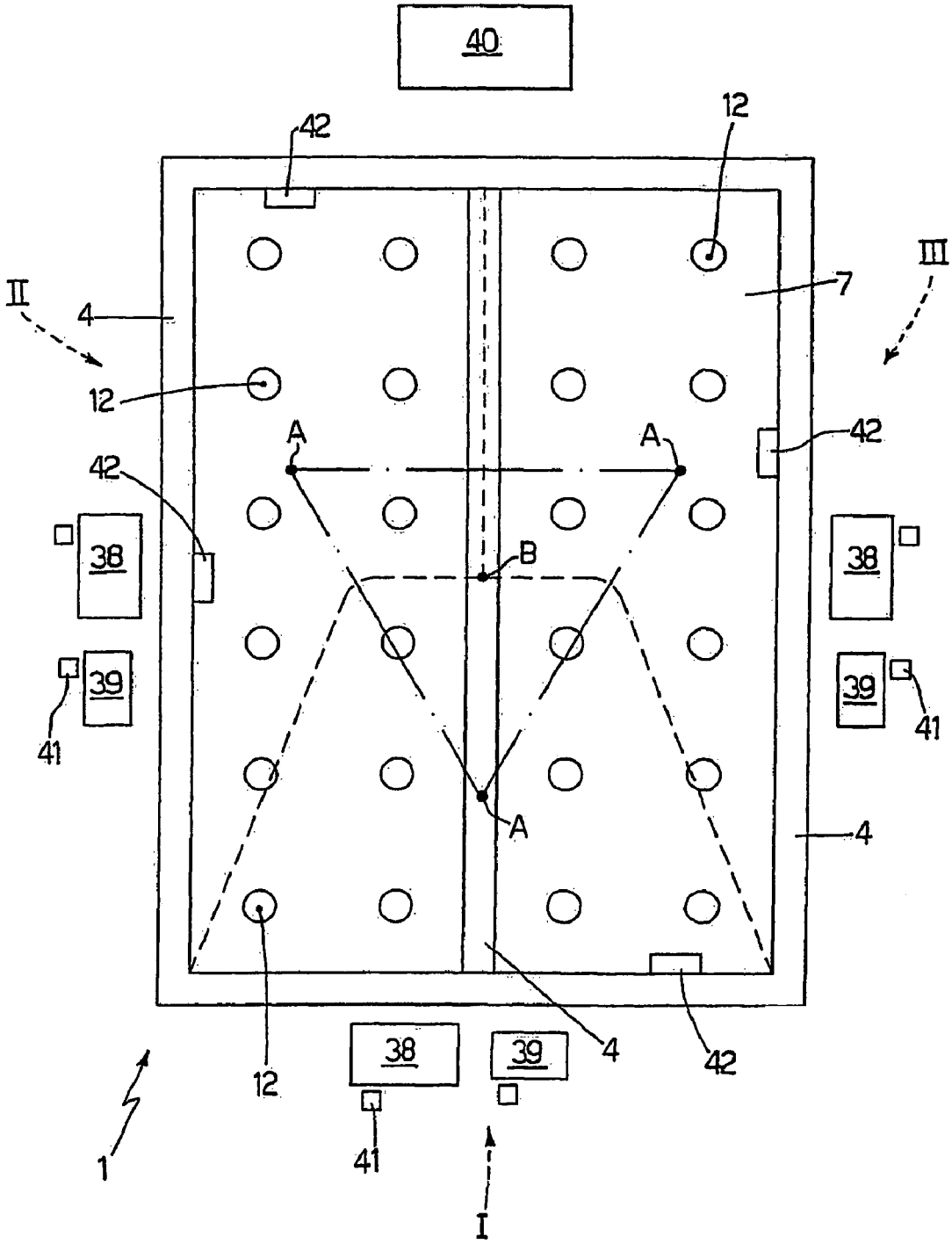

In a preferred embodiment shown in FIG. 12, foundation piles 9 and lifting devices 11 are divided into three equivalent, symmetrical, independent work groups (shown by dash lines in FIG. 12 and indicated by Roman numerals I, II, III). The work groups must be as equivalent as possible, i.e. must comprise roughly the same number of lifting devices 11, and must be as symmetrical as possible, i.e. the thrust barycentres A of the three work groups must correspond as closely as possible to the vertices of a preferably equilateral triangle with its centre at the barycentre B of the weight of building 1 and mat 7.

Lifting devices 11 of each work group are connected to a respective main hydraulic central control unit 38 supplying all the main hydraulic jacks 31, and to a respective secondary hydraulic central control unit 39 supplying all the secondary hydraulic jacks 32. It is important to note that hydraulic central control units 38 and 39 of one work group are independent of hydraulic central control units 38 and 39 of the other work groups.

At the start of the lifting operation, the hydraulic circuits of secondary hydraulic jacks 32 of each work group are connected in parallel to a pump (not shown) by secondary hydraulic central control unit 39, so that all the secondary hydraulic jacks 32 of all three work groups are expanded simultaneously a very short distance (roughly a centimeter) and so pressurized. Next, the hydraulic circuits of secondary hydraulic jacks 32 of each work group are disconnected from the pump and connected in parallel to one another, so that the hydraulic pressure of all the secondary hydraulic jacks 32 in the same work group is maintained constant by virtue of the communicating vessel principle.

At this point, actual lifting of building 1 is commenced. The hydraulic circuits of main hydraulic jacks 31 of each work group are connected in parallel to a pump (not shown)

by main hydraulic central control unit 38; and actual lifting of building 1 is performed by simultaneously expanding the main hydraulic jacks 31 of one work group at a time, while the main hydraulic jacks 31 of the other two work groups are left idle. In other words, the actual lifting of building 1 comprises simultaneously expanding the main hydraulic jacks 31 of one work group at a time to raise the building 2-3 cm per step. As a result, building 1 rotates slightly with respect to the horizontal, which is permitted by the compensating effect of secondary hydraulic jacks 32. In other words, each rotation of building 1 is induced by lifting devices 11 of one work group, and some of the secondary hydraulic jacks 32 of the other two work groups not involved in the lifting operation expand or contract slightly to accompany the different lift levels of the various parts of building 1.

Statically speaking, building 1, reinforced with mat 7, must be thought of as resting on three points (thrust barycentres A) having a spherical hinge (simulated by the hydraulic parallel connection of secondary hydraulic jacks 32), so that lifting can be performed by activating one work group at a time, and the whole building 1 rotates about the axis through thrust barycentres A of the other two idle work groups, without producing any hyperstatic constraints.

Building 1 is normally raised at a very slow speed (calculated at thrust barycentres A of the three work groups) to maintain isostatic conditions. Working at slow speed ensures a wide margin of safety during the lifting operation, in that, by totally eliminating dynamic forces, reference can be made to static-condition standards. Moreover, lifting can be interrupted at any time to monitor, calibrate or make changes to the electric control system or hydraulic system.

At each lift step, building 1 normally tilts by fractions of a degree with respect to the vertical. The building 1 weight force component along the tilt plane is very small, and can easily be balanced (if necessary) by means of ties activated by hydraulic compensating jacks.

As it is being raised, building 1 is monitored constantly by a control unit 40 connected to pressure sensors 41 for measuring the actual pressure of hydraulic central control units 38 and 39, and to a number of wide-base strain gauges 42 fitted to supporting walls 4 of building 1 to measure stress induced by the lifting operation on building 1.

During the lifting operation, mat 7 is also monitored constantly by control unit 40, which is connected to a network of inclinometers (not shown) connected to mat 7 to real-time calculate a graph of deformation of mat 7, and is connected to a precision optical device (not shown) which monitors a number of topographical reference points to occasionally check the inclinometer data. In other words, control unit 40 monitors flexural deformation of mat 7 by means of a main system defined by the inclinometers, and by means of a redundant secondary system defined by the precision optical device.

It is important to note that flexural deformation of mat 7 must be maintained within a very small range and, above all, absolutely stable throughout the lifting operation, on account of it depending substantially on the inevitable distances (which remain constant at all times) between the weight distribution of building 1 and the thrust of lifting devices 11. If a predetermined maximum flexural deformation of mat 7 is exceeded during the lifting operation, the thrust of lifting devices 11 must be balanced better.

Further trimming of mat 7 may be achieved by adjusting opposite posttensioning cables 8 capable of producing predetermined reactions.

Figure 13:
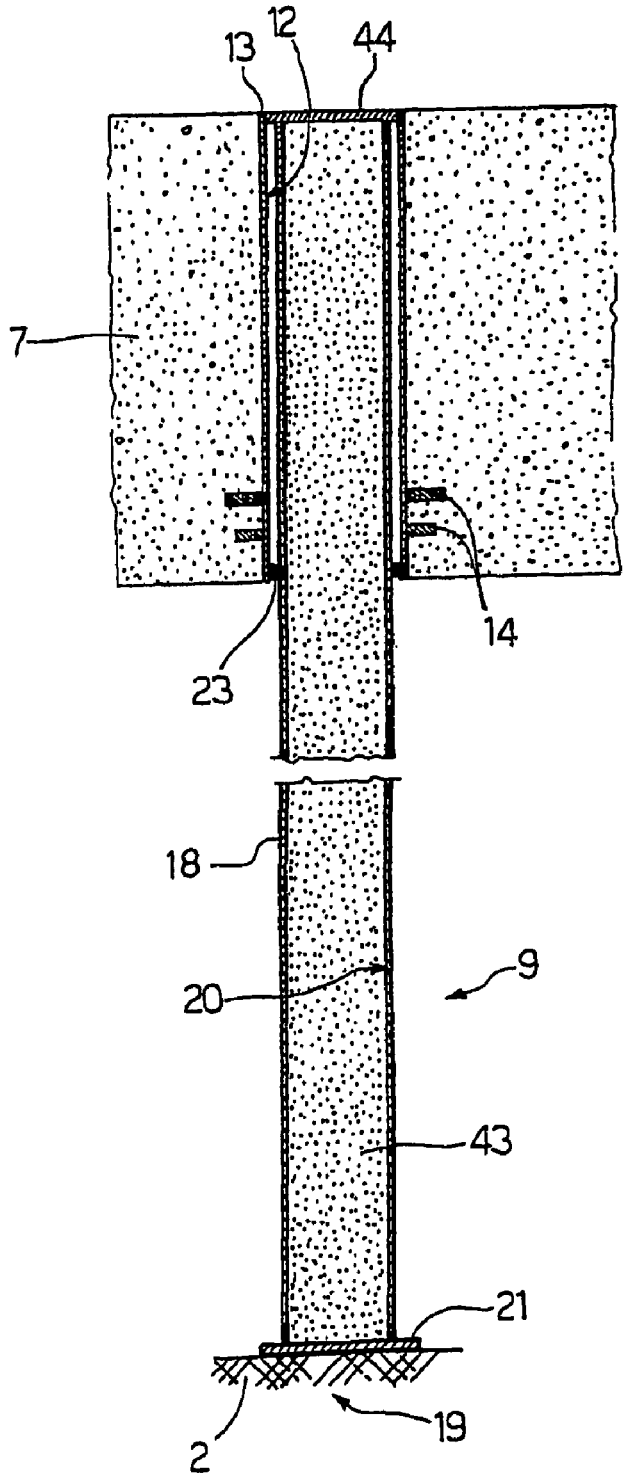
FIG. 13 shows a schematic lateral section of a foundation pile at the end of the lifting operation.

As shown in FIG. 13, once the building is raised, inner conduit 20 of each foundation pile 9 is filled with substantially plastic cement material 43, in particular "concrete". Once inner conduit 20 of each foundation pile 9 is filled, foundation pile 9 is fixed axially to mat 7 by securing (normally welding) to the projecting portion of guide tube 13 a fastening plate (or annular flange) 44, which is placed on top, to engage the top end, of foundation pile 9.

In a different embodiment not shown, a body of elastic material (e.g. neoprene) is interposed, inside guide tube 13, between the top end of foundation pile 9 and fastening plate 44, normally to enhance the antiseismic characteristics of mat 7.

Preferably, each foundation pile 9 is driven so that the top end is below the top surface of mat 7; the projecting portion of guide tube 13 is then cut; and, finally, fastening plate 44 is fixed to the rest of guide tube 13, so it is substantially coplanar with the top surface of mat 7, and the whole top surface of mat 7 can be walked on.

Before being fixed axially to mat 7, foundation pile 9 can be preloaded with a downward thrust of given force for as long as it takes to weld fastening plate 44 to guide tube 13. In other words, downward thrust of given force is exerted on foundation pile 9 when welding fastening plate 44 to guide tube 13. Preloading foundation pile 9 when fixing it to mat 7 allows any yielding of foundation pile 9 to develop rapidly, as opposed to over a long period of time. The advantage of this obviously being that rectifying yield of one or more foundation piles 9 while work is under way is relatively cheap and straightforward, but is much more complicated and expensive once the work is completed.

It should be pointed out that raising the building forms a space underneath mat 7, which may be used to build a basement (obviously, provided there are only a small number of foundation piles 9). Alternatively, the space formed between the underside of mat 7 and ground 2 may be filled with conventional cement materials or nonconventional materials (e.g. polyurethane foam). If the building is raised to a considerable height (about a meter), only the projecting part of foundation piles 9 may be covered to form actual supporting pillars, and filling limited to the areas beneath supporting walls 4; in which case, building 1 would be structurally similar to one built on piles.

Figure 14:
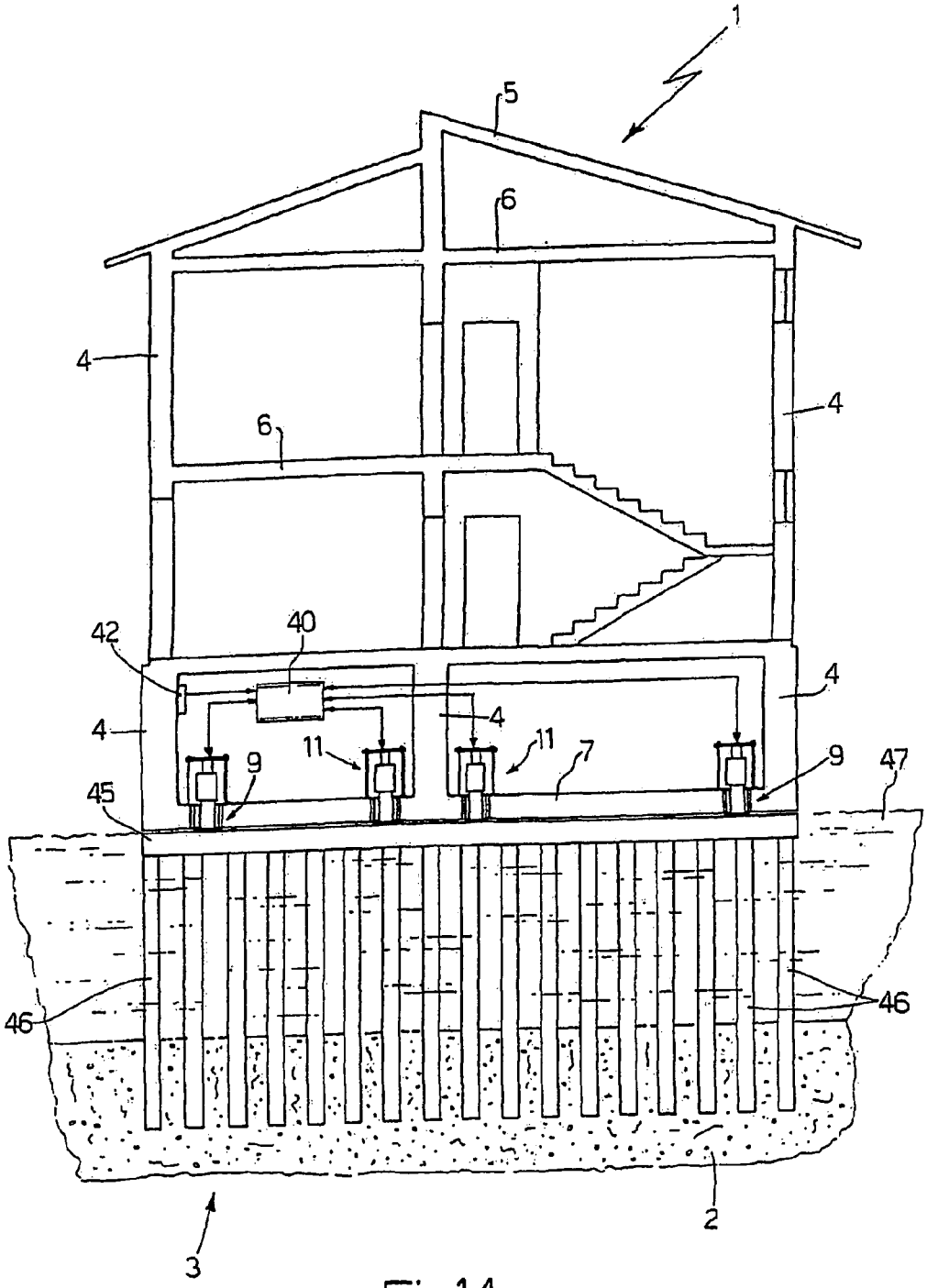
FIG. 14 shows a schematic section of a different building raised using the method according to the present invention.

In a different embodiment shown in FIG. 14, mat 7, as opposed to resting directly on ground 2, rests on a further foundation mat 45 having a large number of piles 46 driven into ground 2 beneath flowing water or a basin of water 47 (e.g. a lagoon). This solution is typical of a building 1 built on water, wherein piles 46 are driven into ground 2 beneath, and support building 1 above, the level of water 47. When mat 7 rests on a further mat 45, the feet 19 of at least some of foundation piles 9 obviously rest on further mat 45; in which case, the foundation piles 9 resting on further mat 45 are obviously not driven into ground 2.

Figure 15:
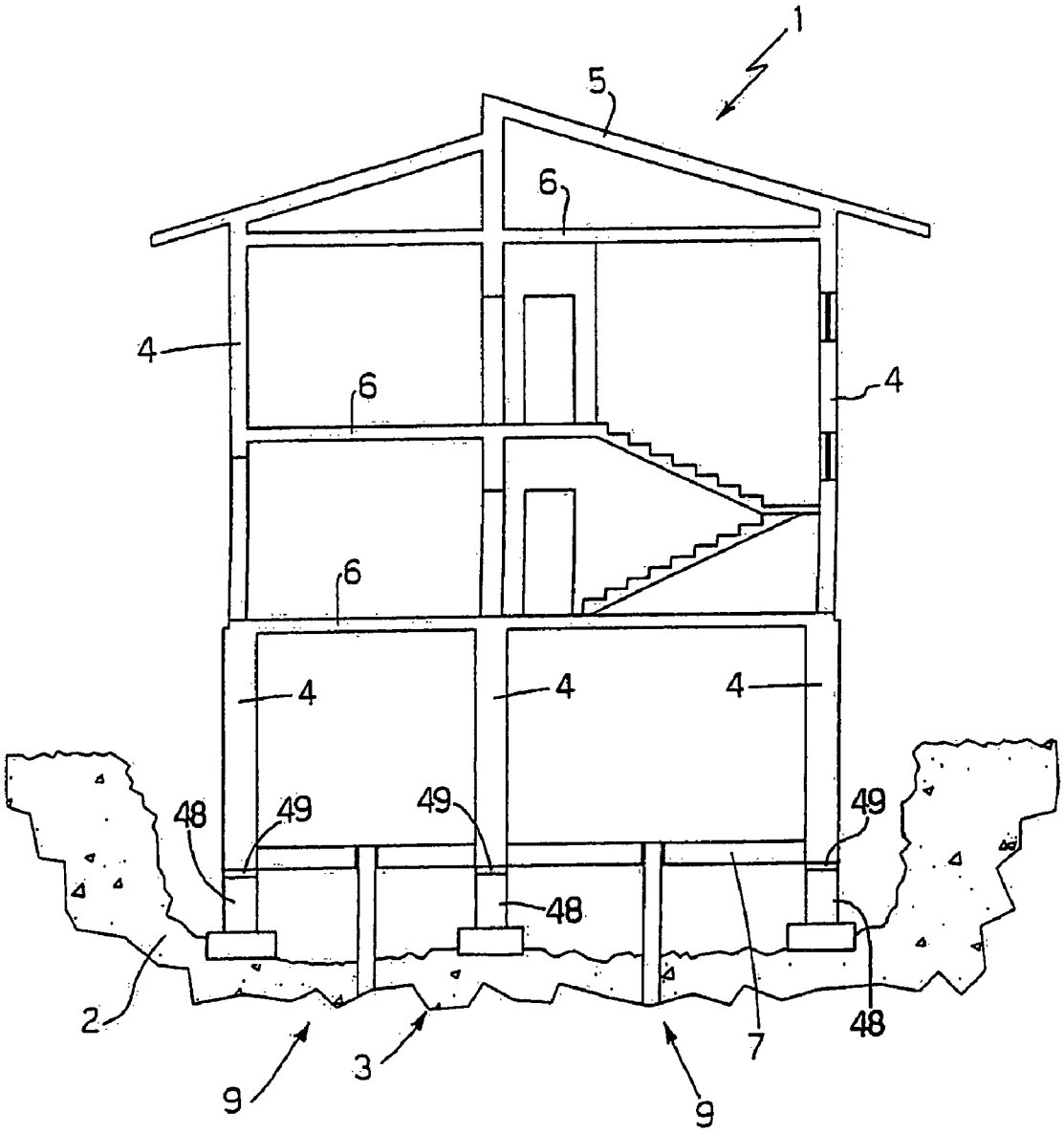

As shown in FIG. 15, once the building is raised, continuity between the old foundation 3 and supporting walls 4 of building 1 may be restored by additional masonry 48. This ensures greater safety and endurance, by building 1 being provided with two foundation systems, each capable of supporting building 1 on its own. More specifically, flat jacks 49 are interposed between additional masonry 48 and supporting walls 4 of building 1, and are expanded to at least partly load the old foundation 3. Each flat jack 49 comprises two metal sheets welded to each other to form a pocket in between, which is filled with pressurized fluid to expand flat jack 49. The fluid used to fill the pocket of flat jack 49 is preferably resin, which tends to set with time to stabilize the situation regardless of the endurance of the pocket.

In the above embodiment, mat 7 is constructed entirely just before the lifting operation. In an alternative embodiment, at least part of mat 7 may already be built, in which case, holes 12 are core-drilled.

In the embodiments shown in the drawings, building 1 has only supporting walls 4. In a different embodiment not shown, building 1 may also have other supporting members (typically, supporting pillars) combined with or instead of supporting walls 4.

If building 1 shares one or more supporting walls 4 with adjoining buildings, all the floors 6 connected to the shared supporting wall 4 must be detached, to lift floors 6 with respect to the shared supporting wall 4, and then reconnected to the shared supporting wall 4. Before being detached from a shared supporting wall 4, floor 6 must obviously be adequately supported by a temporary metal frame adjacent to but not contacting the shared supporting wall 4. The above method may also be applied to particularly large buildings (e.g. with a base of over 1000 sq.m) which are divided into a number of parts raised separately.

The lifting method described above may obviously be used to advantage to raise any type of construction, e.g. a bridge.

The invention claimed is:

1. A method of raising a building having supporting walls supported with respect to the ground and a pre-existing old foundation; the method comprising the steps of:

forming a mat and establishing structural continuity between the mat and the supporting walls, the mat having a plurality of through holes, each surrounded by a number of ties projecting upwards;

inserting a foundation pile through each of the plurality of through holes;

fitting each foundation pile with a lifting device, which comprises at least one hydraulic jack, with one side positioned on a top end of the foundation pile, and is connected, on the other side, to the corresponding ties which act as reaction members;

detaching the building from the pre-existing old foundation;

exerting thrust on the foundation piles by means of the lifting devices to raise the building with respect to the ground; and fixing each foundation pile axially to the mat once the building is raised;

wherein the step of exerting thrust on the foundation piles includes the further steps of:

dividing the lifting devices into at least three, symmetrically positioned independent work groups; and simultaneously activating the lifting devices of only one work group at a time, so that the building along with the mat is raised isostatically, by simultaneously activating the lifting devices of one work group at a time by expanding the relevant hydraulic jacks, while the lifting devices of the other two work groups are left idle.

2. A method as claimed in claim 1, wherein the three work groups are as equivalent as possible, with each comprising about the same number of lifting devices, and are as symmetrical as possible, with thrust barycenters (A) of the three work groups corresponding to the vertices of a triangle with its center at a barycenter (B) of the weight of the building and the mat.

3. A method as claimed in claim 1, wherein the hydraulic jacks of each idle work group are connected in parallel to one another to maintain constant hydraulic pressure in the hydraulic jacks by virtue of the communicating vessel principle.

4. A method as claimed in claim 3, wherein each lifting device comprises a main long-stroke hydraulic jack and a secondary short-stroke hydraulic jack located mechanically in series one over the other; and, during the lifting operation, the secondary hydraulic jacks of each work group are connected in parallel to one another to maintain constant hydraulic pressure in the secondary hydraulic jacks by virtue of the communicating vessel principle.

5. A method as claimed in claim 4, wherein the lifting devices of each work group are connected to a respective main hydraulic central control unit supplying all the main hydraulic jacks, and to a respective secondary hydraulic central control unit supplying all the secondary hydraulic jacks; the hydraulic central control units of one work group being independent of the hydraulic central control units of the other work groups.

6. A method as claimed in claim 4, and comprising the further steps of:

parallel-connecting the hydraulic circuits of the secondary hydraulic jacks of each work group to a pump by means of the secondary hydraulic central control unit at the start of the lifting operation;

simultaneously expanding by a very small distance all the secondary hydraulic jacks of all three work groups;

subsequently disconnecting the hydraulic circuits of the secondary hydraulic jacks of each work group from the pump;

parallel-connecting to one another the hydraulic circuits of the secondary hydraulic jacks of each work group to maintain constant hydraulic pressure in the secondary hydraulic jacks by virtue of the communicating vessel principle; and commencing actual lifting of the building using only the main hydraulic jacks.

7. A method as claimed in claim 4, wherein the main and secondary hydraulic jacks of each lifting device are located between a bottom plate, which rests on a top end of the foundation pile and is fitted through with the ties and has a number of through holes to slide freely along the ties, and a top plate which is fitted through with the ties, and has a number of through holes to slide freely along the ties; and upward sliding of the top plate is arrested by a number of bolts screwed to the ties, on top of the top plate; in each lifting device, the ties are fitted with safety bolts located on top of the bottom plate and kept close to the bottom plate thereby limiting downward travel of the mat.

8. A method as claimed in claim 1, wherein, during the lifting operation, the additional step of monitoring the building constantly by a control unit connected to a number of wide-base strain gauges fitted to the supporting walls of the building to measure stress induced on the building by the lifting operation.

9. A method as claimed in claim 1, wherein, during the lifting operation, the additional step of monitoring the mat constantly by a control unit connected to a network of inclinometers fitted to the mat to calculate in real-time a graph of deformation of the mat.

10. A method as claimed in claim 9, wherein the control unit is connected to a precision optical device, which monitors a number of topographical reference points to occasionally check the data from the inclinometers.

11. A method as claimed in claim 1, wherein the mat forms part of a new foundation, extends along the whole base of the building, and is made of post tensioned concrete; the mat is constructed in portions extending between the walls; to achieve structural continuity between the various portions of the mat and the supporting walls, the mat is post tensioned by means of a number of metal post tensioning cables or bars, each of which is embedded in the mat and inserted through respective through holes in the supporting walls.

12. A method as claimed in claim 1, wherein, for each foundation pile, the mat comprises a vertical hole lined with a metal guide tube, which is fixed to the mat by at least one metal fastening ring embedded in the mat, and has a top portion projecting upwards from the mat.

13. A method as claimed in claim 12, wherein each vertical hole is surrounded with a plurality of threaded anchoring ties, each of which is connected to the fastening ring, extends through the mat, and projects vertically outwards of the mat.

14. A method as claimed in claim 1, wherein the foundation piles are driven into the ground before the lifting operation is commenced; each foundation pile is a metal pile, and comprises a shaft defined by a plurality of butt welded tubular segments of equal length; and a wide bottom foot defining a bottom end of the foundation pile.

15. A method as claimed in claim 14, wherein driving a foundation pile into the ground comprises the steps of:

first inserting the shaft through the hole to engage the foot, which is located beneath the mat, in contact with the ground and coaxial with the hole (12);

placing on top of the foundation pile a pile-driving device, which cooperates with a top end of the foundation pile, and is connected to the ties which act as reaction members; and activating the pile-driving device to expand the pile-driving device and exert thrust on the foundation pile to drive the foundation pile into the ground.

16. A method as claimed in claim 15, wherein, as the foundation pile is sunk into the ground, the foot forms a channel in the ground; and, simultaneously with sinking of the foundation pile into the ground, injecting substantially plastic cement material into the channel through an injection conduit, defined by a tube extending through the mat, with the injection conduit having a top end projecting outwardly from the mat, and a bottom end terminating adjacent the channel.

17. A method as claimed in claim 14, wherein, once the building is raised, the additional step of filling an inner conduit of each foundation pile with substantially plastic cement material; once the inner conduit of each foundation pile is filled, axially fixing the foundation pile to the mat by securing a fastening plate to the projecting portion of the guide tube, with the fastening plate being placed on top of the foundation pile to engage the top end thereof.

18. A method as claimed in claim 1, and comprising the further steps of:

restoring, once the building is raised, continuity between the pre-existing old foundation and the supporting walls of the building by means of additional masonry;

interposing, between the additional masonry and the supporting members of the building, flat jacks each of which comprises two metal sheets welded to each other to form a pocket in between; and expanding the flat jacks to at least partly load the old foundation by filling the pocket of each flat jack with a pressurized fluid resin that will set with time.

19. A method of raising a building having an old foundation and supporting members with respect to the ground; the method comprising the steps of:

forming a mat and establishing structural continuity between the mat and the supporting members, the mat having a plurality of through holes, each surrounded by a plurality of ties projecting upwards;

inserting a foundation pile through each hole;

fitting each foundation pile with a lifting device, which rests on a top end of the foundation pile on one side, and is connected, on the other side, to the corresponding ties which act as reaction members;

detaching the building from the old foundation;

exerting thrust on the foundation piles by means of the lifting devices to raise the building with respect to the ground; and fixing each foundation pile axially to the mat once the building is raised; and the further steps of:

restoring, once the building is raised, continuity between the old foundation and supporting members of the building by means of additional masonry;

interposing, between the additional masonry and the supporting members of the building, flat jacks each of which comprises two metal sheets welded to each other to form a pocket in between; and expanding the flat jacks to at least partly load the old foundation by filling the pocket of each flat jack with a pressurized fluid resin which tends to set with time.

* * * * *

UNITED STATES PATENT AND TRADEMARK OFFICE

CERTIFICATE OF CORRECTION

PATENT NO. : 7,967,531 B2
APPLICATION NO. : 12/292749
DATED : June 28, 2011
INVENTOR(S) : Collina et al.

It is certified that error appears in the above-identified patent and that said Letters Patent is hereby corrected as shown below:

On the title page, item [75], the town of residence for the third inventor, "Roberto Zago," is incorrect. Delete "Roverto", and insert --Rovereto--.

Signed and Sealed this
Nineteenth Day of November, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 7,967,531 B2
APPLICATION NO. : 12/292749
DATED : June 28, 2011
INVENTOR(S) : Collinna et al.

It is certified that error appears in the above-identified patent and that said Letters Patent is hereby corrected as shown below:

On the title page item [73], "S.O.L.E.S.-Societa' Lavori Edili e Serbatoi S.p.A." should read --SO.L.E.S.-Societa' Lavori Edili e Serbatoi S.p.A.--.

Signed and Sealed this
Third Day of November, 2015

Michelle K. Lee

Michelle K. Lee
*Director of the United States Patent and Trademark Office*